US007955024B2

(12) United States Patent
Driscoll et al.

(10) Patent No.: US 7,955,024 B2
(45) Date of Patent: Jun. 7, 2011

(54) INLAY SYSTEM FOR CONCRETE

(75) Inventors: Joe Driscoll, Council Bluffs, IA (US); Dan H. Gernstein, Omaha, NE (US)

(73) Assignee: EZ Set Tile, Inc., Hastings, NE (US)

( * ) Notice: Subject to any disclaimer, the term of this patent is extended or adjusted under 35 U.S.C. 154(b) by 356 days.

(21) Appl. No.: 12/217,993

(22) Filed: Jul. 10, 2008

(65) Prior Publication Data

US 2008/0271662 A1 Nov. 6, 2008

Related U.S. Application Data

(63) Continuation-in-part of application No. 11/004,580, filed on Dec. 3, 2004.

(60) Provisional application No. 60/526,551, filed on Dec. 3, 2003.

(51) Int. Cl.
*E01C 11/24* (2006.01)

(52) U.S. Cl. ..... 404/19; 404/32; 404/35; 52/177; 52/181; 52/315; 411/455; 411/913

(58) Field of Classification Search ..... 52/177, 52/181, 392, 391, 747.11, 315, 180; 404/15, 404/9, 19, 28, 32, 33, 35, 36; 411/455, 456, 411/913, 923

See application file for complete search history.

(56) References Cited

U.S. PATENT DOCUMENTS

| | | | | | |
|---|---|---|---|---|---|
| 3,418,781 | A * | 12/1968 | Penote | 52/699 |
| 4,490,069 | A * | 12/1984 | Cushman et al. | 404/15 |
| 4,715,743 | A | 12/1987 | Schmanski | |
| 5,085,547 | A * | 2/1992 | Vanotti | 411/72 |
| 5,217,319 | A | 6/1993 | Klohn | |
| 5,303,669 | A | 4/1994 | Szenkely | |
| 5,738,278 | A * | 4/1998 | Franz et al. | 238/377 |
| 5,775,835 | A | 7/1998 | Szenkely | |
| 6,350,093 | B1 * | 2/2002 | Petersen et al. | 411/82.1 |
| 6,449,790 | B1 | 9/2002 | Szenkely | |
| 6,709,191 | B1 | 3/2004 | McCuskey | |
| 6,718,714 | B1 | 4/2004 | Montgomery, Sr. | |
| 7,779,581 | B2 * | 8/2010 | Flaherty et al. | 52/177 |
| 2007/0092335 | A1 * | 4/2007 | Wehmeyer | 404/19 |

OTHER PUBLICATIONS

Armor-Tile; Tactile Systems; 09614/ENG, BuyLine 9461; Engineered Plastics Inc., 300 International Drive, Suite 100, williamsville, NY 14221; www.armor-tile.com; 4 pages.

Hanover® Architectural Products Detectable Warning Paver™; 240 Bender Road, Hanover, PA 17331; 4 pages.

(Continued)

*Primary Examiner* — Phi D. A

(74) *Attorney, Agent, or Firm* — Dennis L. Thomte; Thomte Patent Law Office LLC

(57) ABSTRACT

The present invention discloses a tactile warning panel inlay system and method. Such system is comprised of a panel formed with an exposed surface having a plurality of tactile warning protrusions and a support surface configured to contact a substrate matrix. The panel includes a plurality of apertures extending from the exposed surface to the support surface. Further, a plurality of two-piece fasteners are configured to extend individually through an aperture included in the plurality of panel apertures to secure the panel to the substrate matrix. Each fastener includes a head conformed to the shape of the tactile warning protrusion and a threaded shank for extending through the panel and which has an anchor member threadably secured thereto.

2 Claims, 7 Drawing Sheets

OTHER PUBLICATIONS

ADA Compliant Warning and Directional Systems for the Visually Impaired; Detectable Warning Systems, Inc, 6435 Joshua Tree Avenue, Orange, CA 92867; www.detectable-warning.com.

AMS Detectable Warning Systems, Tactile Surfaces; 09782/AMS, BuyLine 8289; AMS Tactile Systems, PO Box 179, North Billerica, MA 01862; 4 pgs.

* cited by examiner

INLAY SYSTEM FOR CONCRETE

CROSS REFERENCE TO RELATED APPLICATION

This is a continuation-in-part application of patent application Ser. No. 11/004,580, filed Dec. 3, 2004, entitled INLAY SYSTEM FOR CONCRETE.

The present application claims the benefit under 35 U.S.C. 119(e) of U.S. Provisional Application Ser. No. 60/526,551, filed Dec. 3, 2003 which is herein incorporated by reference in its entirety.

FIELD OF THE INVENTION

The present invention relates generally to the field of construction and particularly to an inlay system for concrete. More particularly, the present invention relates to a two-piece fastener, a plurality of which are used to anchor a tactile warning panel to a substrate matrix.

BACKGROUND OF THE INVENTION

Cement-type materials such as concrete pervade the construction industry. The durability and strength of concrete makes it particularly well suited for heavy traffic areas such as sidewalks, roadways, and the like. In addition, concrete has been utilized in non-traditional aspects of construction. For example, concrete has been utilized for countertops and other non-traditional surfaces. Concrete surface treatments may allow for various treatments to impart a pseudo stone look, pseudo brick look, and the like such as by including coloring agents and texturing the surface with stamps or the like.

Drawbacks to concrete surface treatments include the level of skill required to accomplish the task, cost, the durability of the surface, and the like. For instance, if a concrete surface is poured as a single slab, a crack in such surface may be repaired only by replacing the entire surface. In addition, concrete surface treatments are limited by the extent to which the pattern must imprint into the concrete. For example, if the difference between an upper surface and the primary (recessed) surface is too large the stamp may not provide a uniform surface or may damage the edge of a raised pattern. As a result, the project may not meet consumer desires.

Therefore, it would be desirable to develop an inlay system for concrete which allows the damaged concrete surface to be repaired without requiring the entire surface to be replaced. Further, it would be desirable for such a system to allow various types and sizes of patterns to be imprinted into concrete surfaces and yet still provide a uniform surface and not cause damage to the edge of a raised pattern.

Although the invention of the co-pending application performs satisfactorily and has met with success, it has been found that it is advantageous to use a plurality of two-piece metal fasteners to anchor the tactile warning panel to the substrate matrix.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In a first aspect of the invention, a tactile warning panel inlay system is disclosed. Such system is comprised of a panel formed with an exposed surface including a plurality of tactile warning protrusions and a support surface configured to contact a substrate matrix. The panel includes a plurality of apertures extending from the exposed surface to the support surface. Further, a plurality of fasteners are configured to extend individually through an aperture included in the plurality of panel apertures to secure the panel to the substrate matrix. Each fastener includes a head conformed to the shape of the tactile warning protrusion and a body for extending the fastener through the panel and into the substrate matrix.

In a second aspect of the invention, a method of placing a panel into a substrate matrix is disclosed. Such method is comprised of setting a panel into a substrate matrix, the panel formed with an exposed surface having a texture and a support surface configured to contact a substrate matrix. Further, the panel includes a plurality of apertures extending from the exposed surface to the support surface. Each panel is then fastened with a plurality of fasteners into the matrix, each fastener configured to extend individually through an aperture included in the plurality of panel apertures to secure the panel to the substrate matrix. The fastening of the panel with the plurality of fasteners allows a secure mechanical connection among the fastener, the panel and the substrate matrix to be formed.

In the instant invention, a plurality of two-piece fasteners are used to anchor the tactile warning panel in the substrate matrix. Each of the fasteners includes a stainless steel bolt including a head portion and a threaded body or shank portion. Prior to the tactile panel being partially embedded in the substrate matrix, a bolt is extended through each of the apertures and an internally threaded zinc anchor member is threaded onto the threaded shank portion of the bolt from beneath the lower surface of the panel until the upper end of the anchor member engages the lower surface of the panel. The panel with the fasteners secured thereto is then partially embedded in the substrate matrix which embeds the anchor members in the substrate matrix to anchor the panel to the substrate matrix.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

The numerous advantages of the present invention may be better understood by those skilled in the art by reference to the accompanying figures in which.

DETAILED DESCRIPTION OF THE INVENTION

Figure 1:
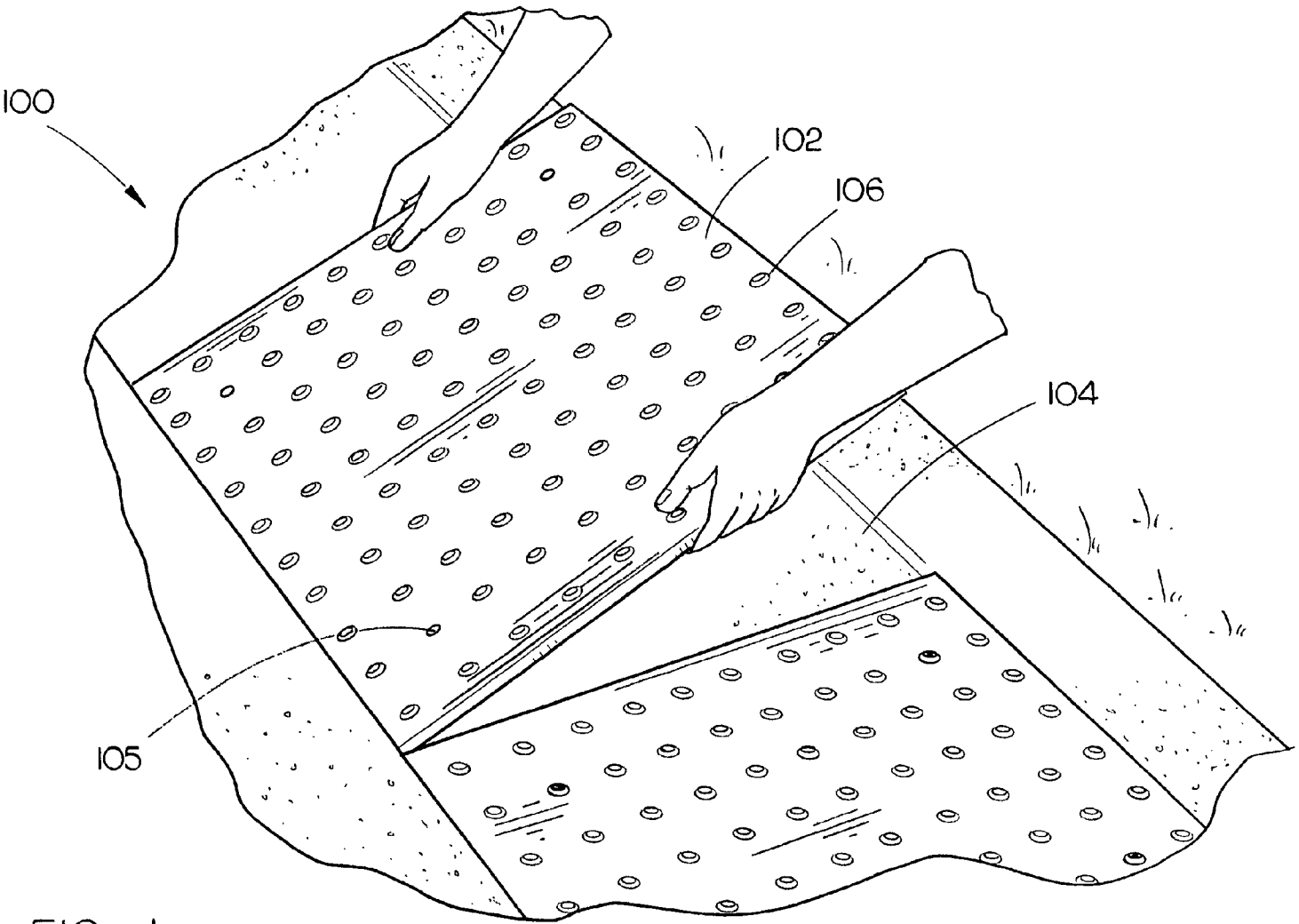
FIG. 1 is an illustration of a tactile warning panel inlay system in accordance with an exemplary embodiment of the present invention, wherein an inlay panel is being at least partially recessed into a concrete matrix.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Reference will now be made in detail to the presently preferred embodiments of the invention, examples of which are illustrated in the accompanying drawings. In the drawings, FIGS. 1-3 illustrate the panel inlay system of the copending application FIGS. 4-9 Illustrate the panel inlay system of the present invention.

Figure 2A:
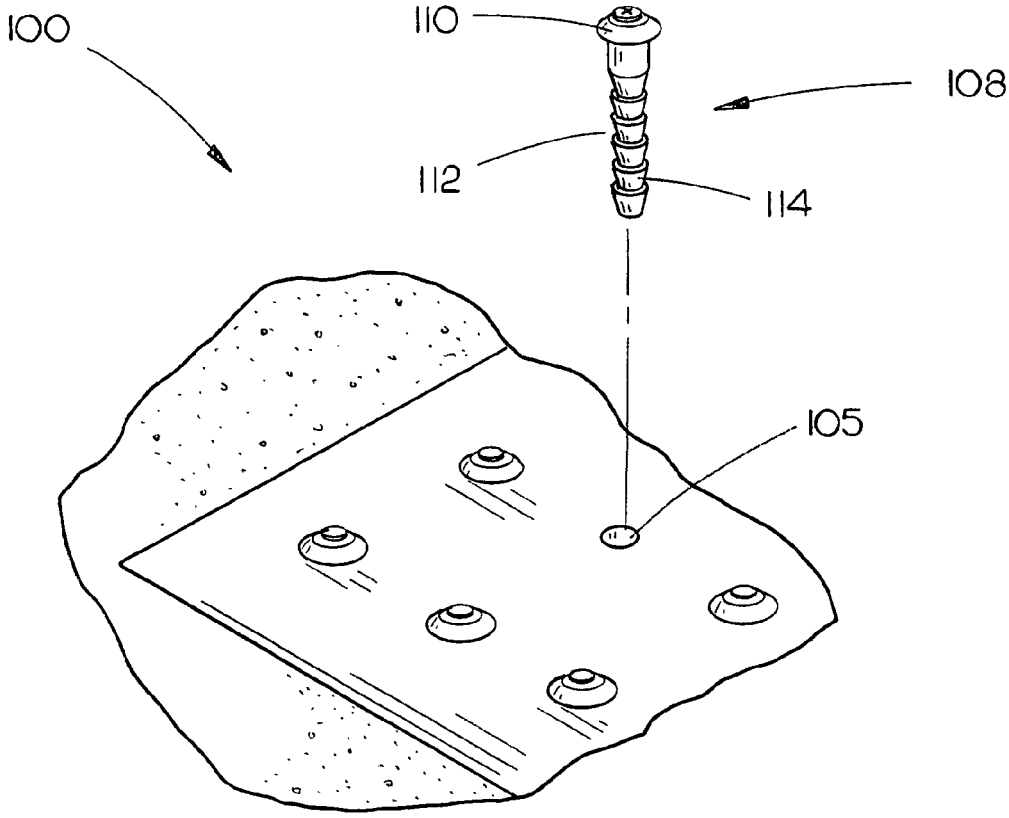
FIG. 2A is an exploded partial view of the inlay panel shown in FIG. 1, wherein a connector is employed to secure the panel to the matrix.
Figure 2B:
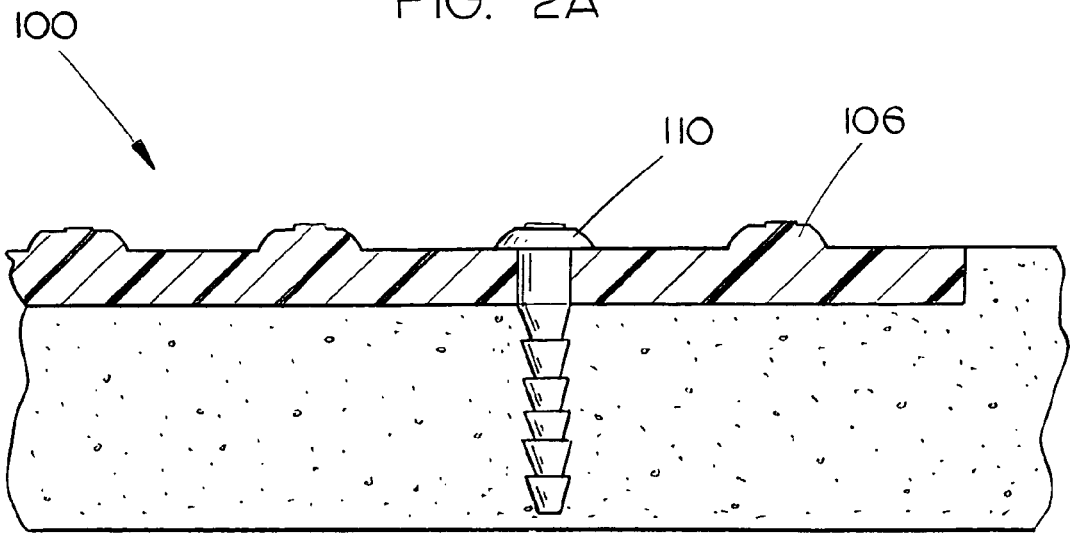
FIG. 2B is a cross-sectional side view of the inlay panel shown in FIG. 1, wherein the panel is secured to the matrix via a connector so that the connector is flush with corresponding protrusions.
Figure 3:
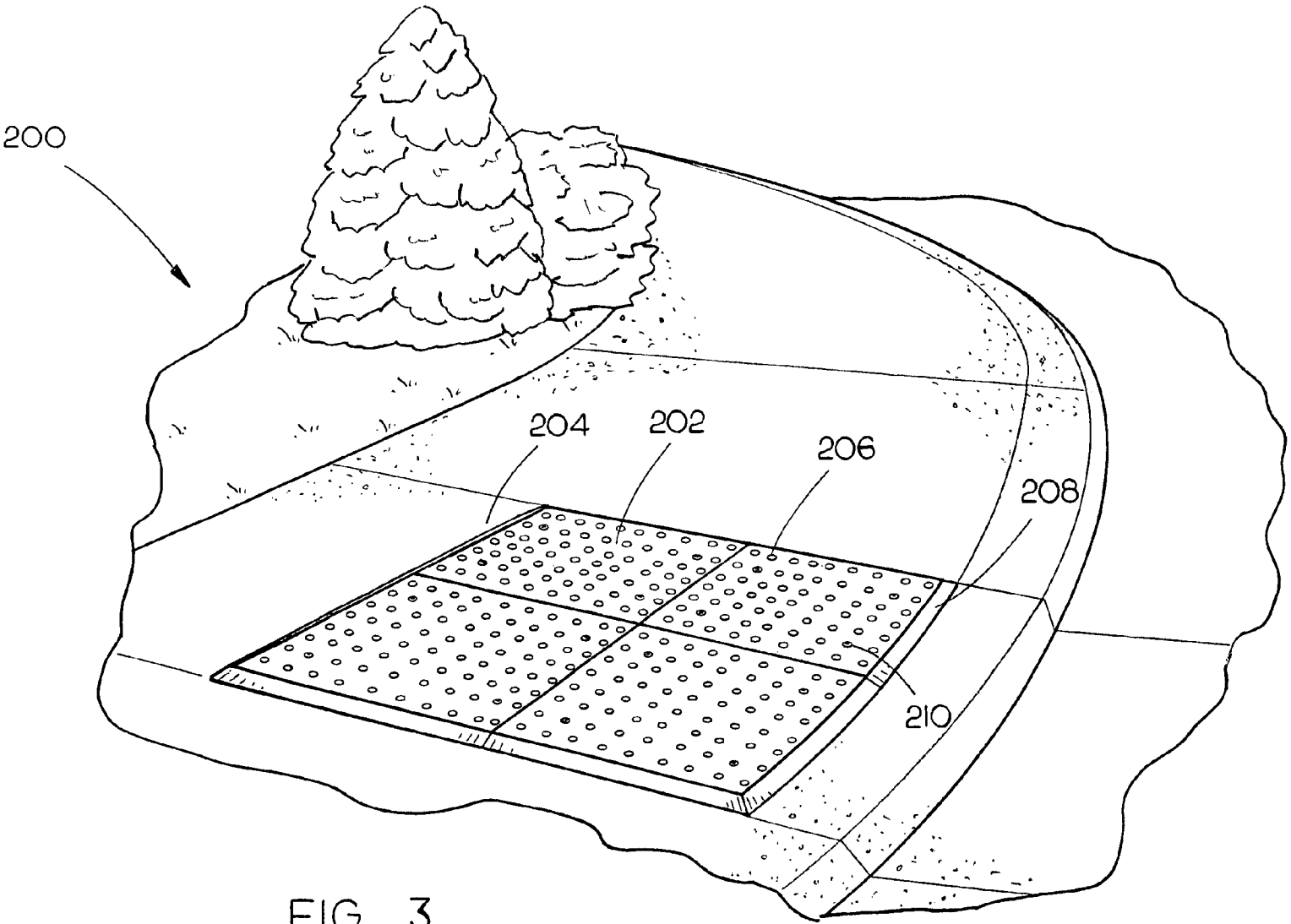
FIG. 3 is an example of retrofitting a preexisting surface with surface panels in accordance with an exemplary embodiment of the present invention.
Figure 4:
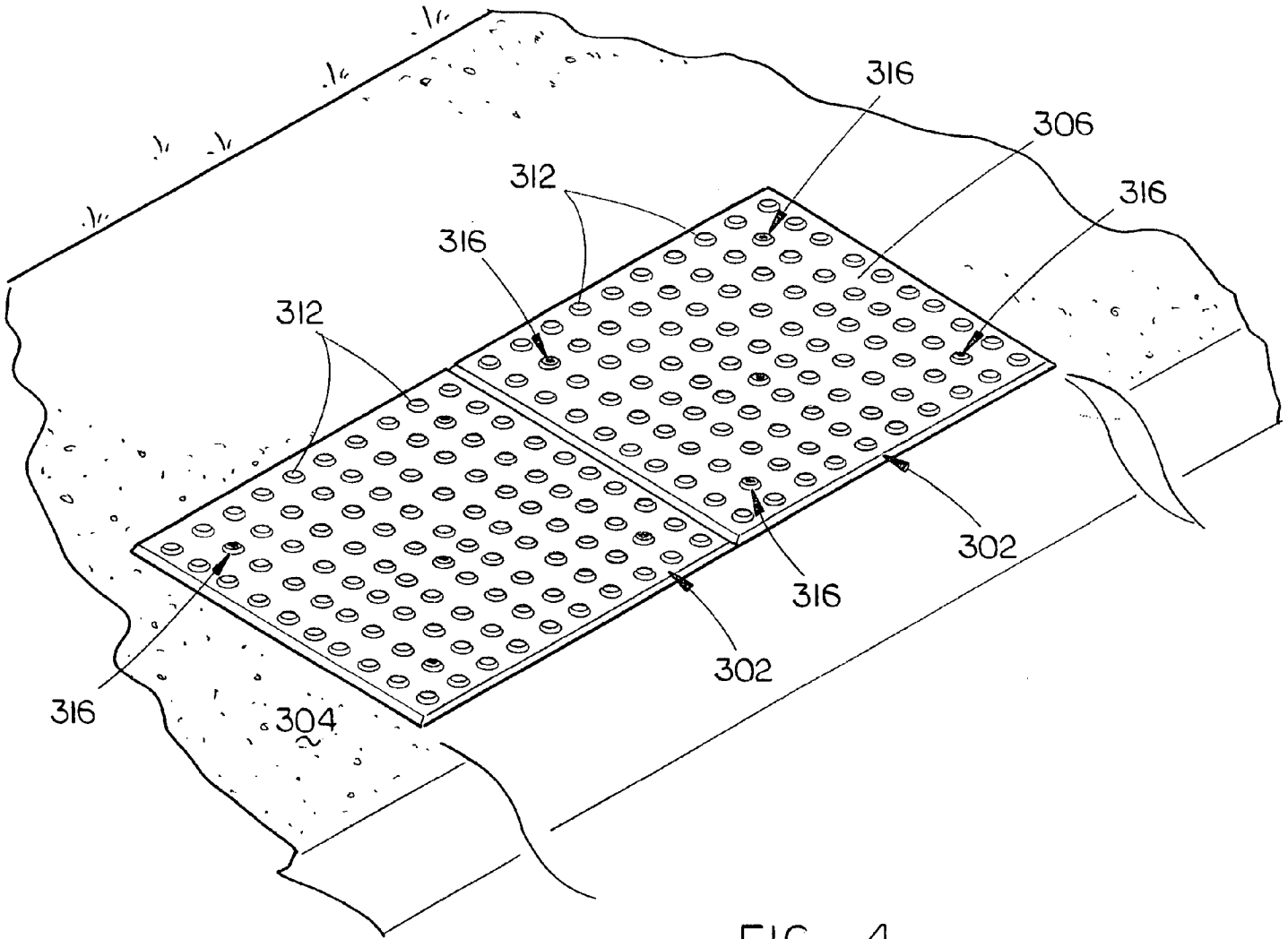
FIG. 4 is a perspective view of a pair of panels secured to a substrate matrix with the two-piece fasteners of the instant invention.
Figure 6:
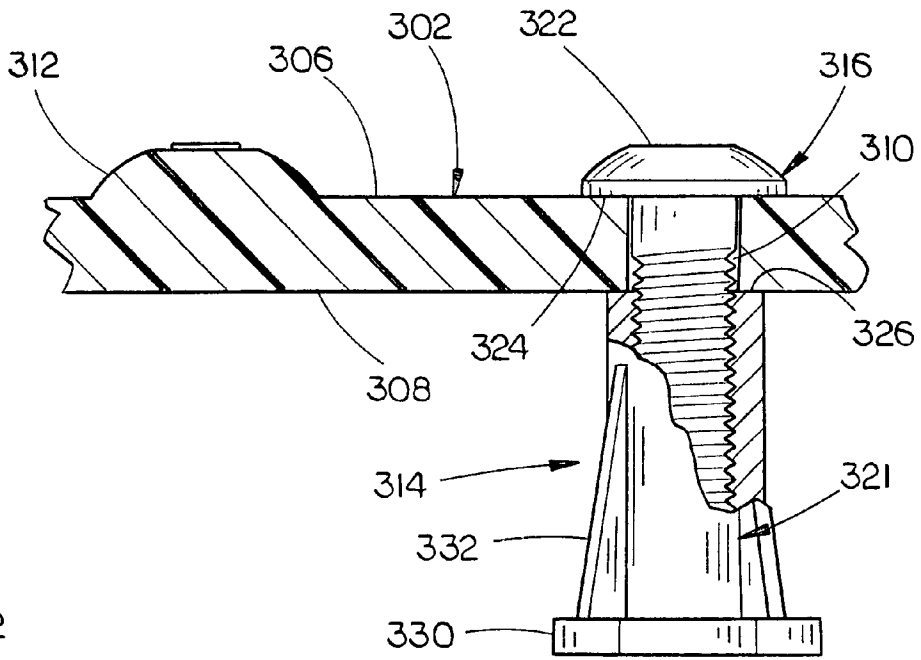
FIG. 6 is a sectional view illustrating the manner in which the two-piece fastener is attached to a panel.
Figure 5:
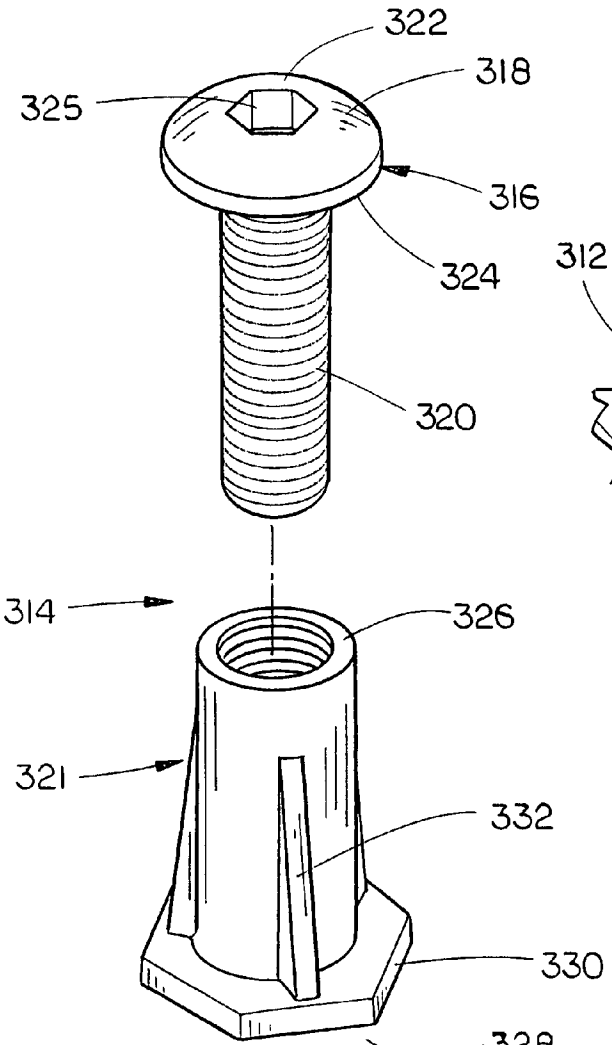
FIG. 5 is an exploded perspective view of the two-piece fastener of the instant invention.
Figure 7:
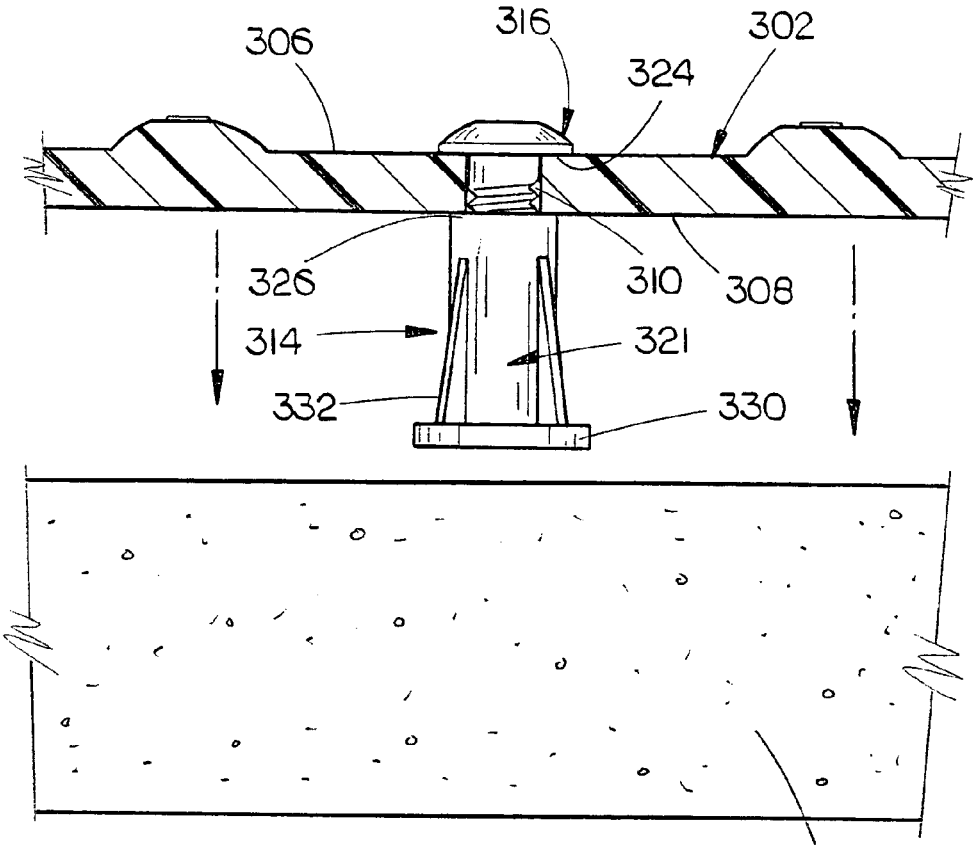
FIG. 7 is a sectional view illustrating a panel having the two-piece fasteners attached thereto and is moved downwardly towards the substrate matrix.
Figure 8:
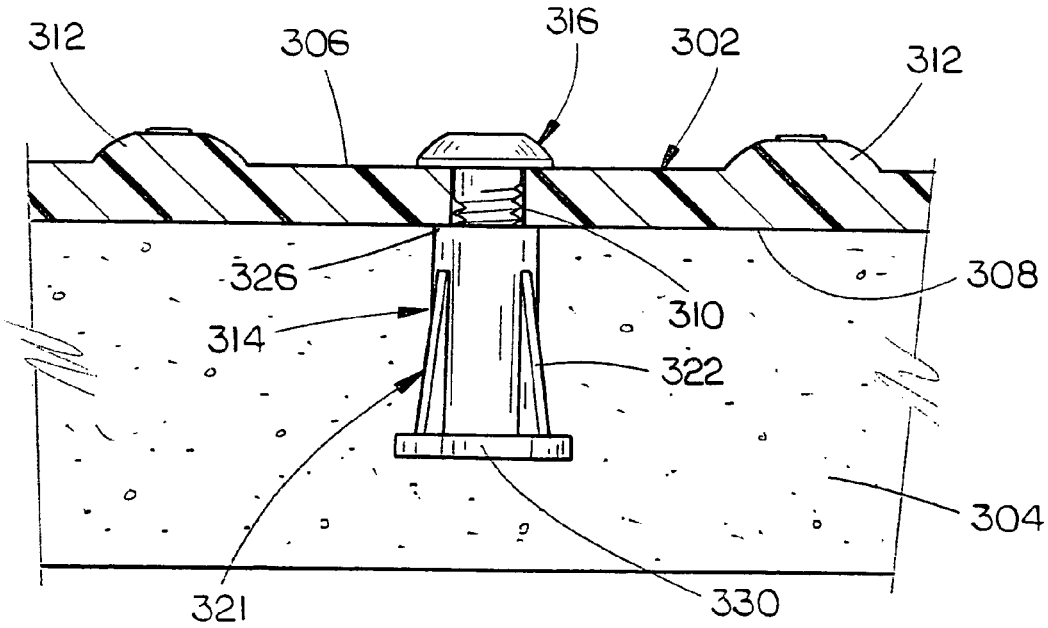
FIG. 8 is a sectional view similar to FIG. 7 except that the two-piece fastener has been embedded into the substrate matrix.
Figure 9:
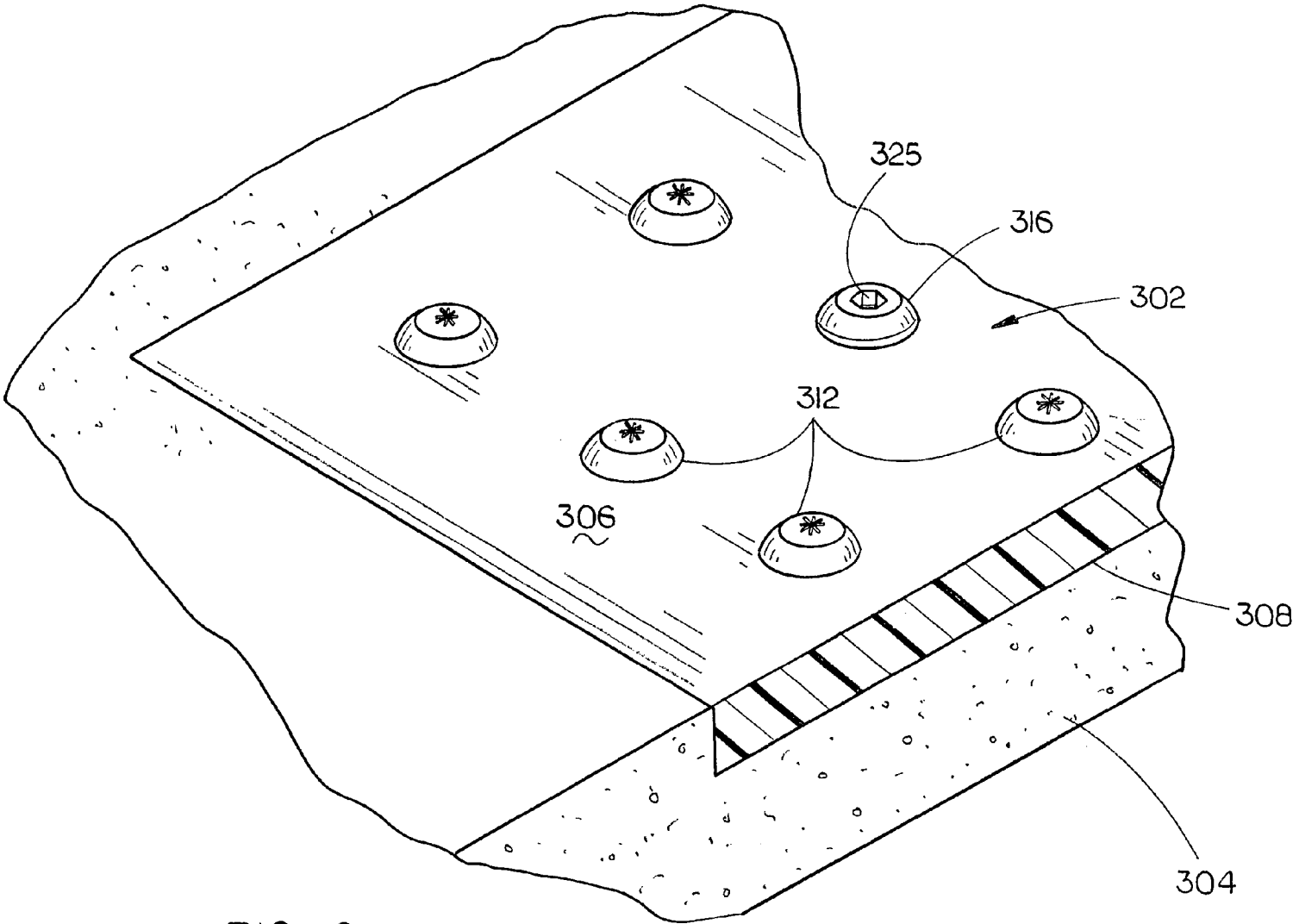
FIG. 9 is a partial top perspective view illustrating a panel embedded in the substrate matrix and which illustrates a plurality of tactile warning protrusions and the head portion of one of the two-piece fasteners.

Referring in general to FIGS. 1-3, a panel inlay system in accordance with the present invention is disclosed. In one exemplary embodiment, the panel inlay system functions as a tactile warning system whereby panels include tactile warning protrusions. In use, the panel protrusions provide a tactile warning for the sight-impaired at intersections, cross-walks, platforms for mass transit, and the like, where tactile indicators are desired whereby such protrusions are easily detected by normal cane sweeping action. In addition, the panel protrusions may provide a tactile warning to drivers at intersections, road shoulders, and the like. In alternative embodiments, the panel inlay system may be used to provide a decorative surface such as providing a pseudo brick or stone for connection to a concrete or masonry substrate, such as for counter-top, around exposed foundations and the like. The inlay panel may allow for a greater height difference between the primary surface and the raised portion of the panel than a concrete surface treatment. For example, raised protrusions may be required to meet governmental standards when utilized for tactile indicator. In additional embodiments, other surfaces may be formed as desired.

Referring specifically to FIG. 1, a panel inlay system 100 configured to function as a tactile warning system is disclosed. An inlay panel 102 is at least partially recessed into a substrate matrix 104. In one embodiment, the substrate matrix includes concrete. In alternative embodiments, such matrix may include asphalt and the like. The inlay panel 102 includes an exposed surface and a support surface. Further, the panel 102 includes a plurality of apertures 105 extending from the exposed surface to the support surface. The exposed surface is textured while the support surface is configured to contact a substrate matrix. In the present embodiment, the exposed surface is textured with protrusions 106 in the shape of truncated dome structures. Moreover, the support surface of the panel 102 is generally smooth to allow for a difference in the expansion rates for the substrate (such as a concrete pad) versus the panel material. The forming of the panel 102 with a generally smooth support surface may also allow for ease of removal if the panel 102 should become damaged, or if replacement is desired.

In an exemplary embodiment, the panel 102 has an average thickness of approximately in the range of a ½" (a half inch) so as to minimize transport cost, promote efficient installation and the like. For instance, a 2'×2' (two foot by two foot) panel may weigh in the range of approximately 25 pounds such that the panels may be easily transported. Furthermore, the utilization of ceramic based tiles may allow for sufficient durability without increasing the weight of the panel such when compared to a panel formed entirely from a Portland cement type material. It is contemplated that those of ordinary skill in the art will appreciate that a panel may be formed in various shapes to accommodate site specifications, consumer requirements, and the like.

In an additional exemplary embodiment of the present invention, the panel 102 is formed of material suitable for coloring. For example, the inlay panel 102 may be formed of ceramic material or the like having sufficient durability and resistance to damage from freeze/thaw cycles, resistance to chemicals such as salt/calcium chloride or other chemicals for removing ice. In the previous example, the tile color may be influenced by the constituent materials, such as pink quartzite aggregate. In further examples, coloring agents such as silica encapsulated colorings (to minimize UV fading), mineral coloring agents such as iron oxides and the like are utilized. Furthermore, the ceramic matrix may include fiber for reinforcement, additives such as particles of reflecting material, accelerators, fly ash, Portland cement (to aid in set up and product appearance), anti-skid particles or other similar materials.

In additional exemplary embodiments, the surface of the panel 102 may be coated with a protective coating such as a sealant, to increase reflectivity over a standard ceramic. For instance, the panel 102 may be covered with a high durability silane sealer to minimize UV damage, resist staining, and the like. In alternative embodiments, the panel 102 may be fabricated with a high strength rating allowing panels to withstand heavy use and heavy equipment. For example, the panel 102 may be fabricated to withstand higher pressures (over that of the base substrate) or to withstand in the range of 10,000 PSI (pounds per square inch) while the base concrete material may be in the range of 4,000 PSI. In still further embodiments, reinforcing fibers may be included to increase the flexural strength of the panel 102. Suitable reinforcing materials include fiberglass, woven polymeric fibers such as spun polypropylene, and the like.

As illustrated in FIGS. 2A and 2B, the panel inlay system 100 utilizes fasteners or mechanical connectors 108 for securing the panel into the substrate matrix 104 whereby individual fasteners 108 extend through the panel 102 via panel apertures 105 to secure the panel 102 to the substrate matrix 104. In the present embodiment, each fastener 108 includes a head 110 and a body 112. Further, the fastener 108 includes a series of ribs 114 on the body 112 which assists in the fastener 108 to engage with the wet substrate matrix 104 and generate a secure mechanical connection to withstand heavy use and heavy machinery. In an exemplary embodiment, five fasteners are employed for a 2'×2' (two feet by two feet) inlay panel.

In an exemplary embodiment, the fastener 108 is generally cylindrical or conical so that should the inlay panel 102 or fastener 108 become damaged, the secured fastener 108 may be drilled-out and a replacement fastener secured via an adhesive such as an epoxy or a mortar mixture. Suitable materials for the fastener 108 include ABS (Acrylonitrile Butadiene Styrene) type plastics, polyethylene based materials, fiber reinforced plastics, such as fiber reinforced polypropylene (e.g., reinforced with fiberglass) or fiber reinforced polyester, and the like. Further, it is contemplated that suitable fastener material may be of sufficient durability to withstand snow removal operations in inclement areas and the like. While metal fasteners may be utilized, ferrous based fasteners may not have the durability, become rusted, or detract from the aesthetics of the project.

As illustrated in FIG. 2B, when the panel inlay system 100 is utilized as a tactile warning system, the head 110, included within the fastener 108, is formed to match the desired protrusion 106. In alternative embodiments, a head 110 included on a fastener 108 may be disposed in a recess or pocket in the panel so that the fastener 108 does not extend beyond a primary surface on a panel 102.

In additional embodiments, the present invention may allow for pre-existing substrates to be retrofitted with panels without having to replace the substrate. In one embodiment, the pre-existing substrate is retrofitted with the panel inlay system 100 by creating a recess of the desired depth in the substrate by grinding such area or subjecting the desired area to an acid/chemical treatment. Following such action, the inlay panels 102 are recessed into the substrate 104 as discussed above.

Alternatively, as illustrated in FIG. 3, the panel inlay system 200 is employed to retrofit a pre-existing surface with the desired panels in which a surface panel 202 is secured directly to a surface 204 without recessing or inlaying the panel 202 into the surface 204. In such embodiment, the surface panel 202 includes an exposed surface and a support surface, the exposed surface may be textured. In the present embodiment, the texture of the exposed surface includes protrusions 206. Further, the support surface is configured to contact the pre-existing surface. In one embodiment, the surface of the support surface is smooth allowing for panels to be easily removed if desired and a flush fit with the pre-existing surface to be obtained. In addition, the surface panel 202 includes a plurality of apertures 210 extending from the exposed surface to the support surface. In alternative embodiments, the surface panel 202 interlocks with additional surface panels via a flange and a lip assembly.

The surface panel 202 is placed on the desired surface 204 and then coupled to such surface. In an exemplary embodiment, surface panel 202 is coupled to the surface 204 via a plurality of connectors or mechanical fasteners (as described above) via the placement of the connectors or mechanical fasteners in the plurality of apertures 210 present within the surface panel 202. In additional embodiments, surface panel 202 may be attached to the surface 204 via adhesive or mortar mixture. Adhesive or mortar mixture may be used in addition to or in lieu of the connectors. Further, such agents may be place within the apertures 210 and/or on the support surface of the surface panel 202.

Additionally, in one embodiment, the surface panel 202 may include one or more tapered or beveled edges 208. In the present embodiment, the beveled edges 208 are located around the outer most edges of the panel inlay system 200. In use, the beveled edges 208 allow the user to enter the panel inlay system 200 gradually thereby preventing a user from tripping. In an alternative embodiment, the surface panel 202 is graded whereby one end of the panel is approximately flush with the pre-existing surface 204 and the opposite end is at a desired elevation. For example, a graded panel inlay system may be used to direct a user to door opening areas at bus stations, train stations and the like.

In a further embodiment, a panel may be at least partially covered by a removable film or wrapper. For example, a removable plastic film may be included to prevent the exposed surface from being exposed to wet concrete prior to the concrete curing. The protective film may also include apertures or perforations corresponding to the apertures in the panel or may be configured for allowing a fastener to pierce the film. For example, a panel may be at least partially recessed into the concrete substrate, fasteners secured into apertures included in the panel, the concrete broom finished (or wood float finished or the like) and then a protective film removed from the panels. Those of ordinary skill in the art will appreciate that the exact order may be varied without departing from the scope and spirit of the present invention.

The panel inlay system 300 of FIGS. 4-9 is identical to the panel inlay systems 100 of FIGS. 1, 2A and 2B and may be identical to the panel inlay systems 200 of FIG. 3 except for the fasteners used to anchor the tactile warning panels to the substrate matrix as will now be described.

In FIGS. 4-9, the inlay panel 302 will be at least partially recessed into the substrate matrix 304. In one embodiment, the substrate matrix includes concrete. In alternative embodiments, such matrix may include asphalt and the like. The inlay panel 302 includes an upper exposed surface 306 and a lower support surface 308. Further, the panel 302 includes a plurality of apertures 310 extending from the exposed surface to the support surface between the protrusions 312 in the shape of truncated dome structures. The panel 302 is formed in the same way as discussed above and has the same dimensions as discussed above and which will not be repeated again for purposes of conciseness.

As illustrated in FIGS. 4-9, the fasteners or mechanical connectors of FIGS. 1-3 are replaced by fasteners 314. Each of the fasteners 314 are two-piece fasteners comprised of a stainless steel bolt 316 having a truncated dome-shaped head portion 318 having substantially the same exterior configuration as the protrusions 312 and which has a threaded shank portion 320 extending downwardly therefrom. Fastener 314 also includes an internally threaded anchor member 321. Head portion 318 will be described as having an upper end 322 and a lower end 324. The diameter of lower end 324 of head portion of 318 is greater than the diameter of the associated aperture 310. Head portion 318 has a socket 325 extending downwardly thereinto adapted to receive an alien wrench or the like.

Anchor member 321 includes an internally threaded tubular portion 326. including an upper end 327 and a lower end 328. The anchor member 321 is provided with a laterally extending flange or foot 330 which extends from the lower end of tubular portion 326 and which has a width greater than the diameter of the tubular portion 326. Preferably, a plurality of tapered gussets or ribs 332 extend outwardly from tubular portion 326 in a radially spaced-apart manner. Preferably, anchor member 321 is comprised of a zinc material.

Prior to the panel 302 being embedded in the substrate matrix, the shank portions 320 of the bolts 316 are extended through each of the apertures 310. Anchor members 321 are then threadably mounted on the threaded shank portions 320 of the bolts 316 below the panel 302 and are threaded upwardly on the bolts until the upper ends 327 of the tubular portions 326 are in engagement with the lower support surface of the panel 302.

The panel 302 is then partially embedded in the substrate matrix in the same manner as the other panels described above which causes the anchor members 321 to be embedded in the concrete. When the concrete has hardened, the foot 320 on the anchor member 321 prevents the anchor member 321 from being pulled upwardly from the concrete. The tapered gussets or ribs 332 prevent the anchor member 321 from rotating in the hardened concrete.

One advantage of the use of the two-piece fasteners 314, is if the panel 302 should become damaged and needs replacement, the bolts 316 in the panel 302 may be threadably removed from the anchor members 321 so that the panel 302 may be removed from the substrate matrix. The foot 330 and the gussets or ribs 332 prevent the anchor member 321 from being pulled from the concrete when the panel 302 is being replaced. The stainless steel construction of the bolt 316 and the zinc construction of the anchor member 321 prevents the same from rusting which would make it difficult to remove the bolts 316 from the anchor members 321 when a panel replacement is required.

As stated, the upper end of the head portion 318 of the bolt 316 is provided with a socket 325 to facilitate the tightening of the bolt 316 to the anchor member 321 and to facilitate the removal of the bolt 316 from the anchor member 321 should panel replacement be required.

Thus it can be seen that a novel two-piece fastener assembly has been provided which enables a tactile warning panel to be secured or embedded in a substrate matrix while yet permitting the panel to be removed from the substrate matrix should the need arise. It can therefore be seen that the invention accomplishes at least all of its stated objectives.

It is believed that the present invention and many of its attendant advantages will be understood by the foregoing description, and it will be apparent that various changes may be made without departing from the scope and spirit of the invention or without sacrificing all of its material advantages. The form herein before described being merely an explanatory embodiment thereof, it is the intention of the following claims to encompass and include such changes.

Further, it is understood that the specific order or hierarchy of steps in the methods disclosed are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A tactile warning panel inlay system, comprising:

a panel having an upper surface and a lower surface;

a plurality of spaced-apart tactile warning protrusions extending upwardly from said upper surface of said panel;

a plurality of fastener apertures formed in said panel between said protrusions with the upper surface of said panel being continuous and devoid of any other openings except for said fastener apertures;

a bolt positioned in each of said fastener apertures;

each of said bolts having a head portion and a threaded shank portion extending downwardly therefrom;

said threaded shank portion of each of said bolts having a diameter which is less than the diameter of said head portion thereof;

each of said head portions of said bolts having an upper end and a lower end;

said lower end of said head portion of each of said bolts having a diameter greater than the associated aperture so that said lower end of said head portion rests on said upper surface of said panel;

said threaded portions of said bolts extending downwardly through said fastener apertures;

an internally threaded anchor member, having upper and lower ends, threadably mounted on each of said threaded shank portions of said bolts below said lower surface of said panel to anchor said panel to a substrate matrix;

said head portions of said bolts having substantially the same configuration as said tactile warning protrusions so that said head portions of said bolts also function as tactile warning protrusions;

each of said anchor members including an internally threaded tubular portion having an upper end and a lower end;

each of said anchor members having a laterally extending flange which extends from the lower end of said tubular portion which has a width greater than the diameter of said tubular portion.

2. The tactile warning panel of claim 1 wherein at least one laterally extending and vertically disposed web extends between said tubular portion and said flange.

* * * * *